US007089757B2

(12) United States Patent
Yang

(10) Patent No.: US 7,089,757 B2
(45) Date of Patent: Aug. 15, 2006

(54) DEVICE FOR COOLING OBJECT

(76) Inventor: Jung Wook Yang, #1521 Daewoo-Maison Livr bldg., Janghang-dong 750-1,Ilsau-gu, Goyang-si, Gyeonggi-do 411-830 (KR)

( * ) Notice: Subject to any disclaimer, the term of this patent is extended or adjusted under 35 U.S.C. 154(b) by 0 days.

(21) Appl. No.: 10/511,692

(22) PCT Filed: Apr. 15, 2003

(86) PCT No.: PCT/KR03/00760

§ 371 (c)(1),
(2), (4) Date: Oct. 14, 2004

(87) PCT Pub. No.: WO03/089857

PCT Pub. Date: Oct. 30, 2003

(65) Prior Publication Data

US 2005/0126208 A1 Jun. 16, 2005

(30) Foreign Application Priority Data

Apr. 15, 2002 (EP) ..... 02008539

(51) Int. Cl.
*F25O 3/08* (2006.01)

(52) U.S. Cl. ..... 62/457.4; 62/371; 62/457.2; 62/530

(58) Field of Classification Search ..... 62/457.1, 62/457.2, 457.3, 457.4, 371, 530
See application file for complete search history.

(56) References Cited

U.S. PATENT DOCUMENTS 4,324,111 A * 4/1982 Edwards ..... 62/457.4
4,344,303 A 8/1982 Kelly
4,399,668 A * 8/1983 Williamson ..... 62/457.4
4,514,993 A * 5/1985 Johnson ..... 62/372
4,596,250 A * 6/1986 Beisang et al. ..... 607/114
4,676,247 A * 6/1987 Van Cleve ..... 607/112
4,831,842 A 5/1989 Kelley et al.
4,989,418 A 2/1991 Hewlett
5,313,807 A 5/1994 Owen

FOREIGN PATENT DOCUMENTS

EP 0526928 A1 * 8/1992
JP 05-254572 10/1993
JP 06-073677 10/1994
JP 06-337189 12/1994

OTHER PUBLICATIONS

International Search Report for corresponding International Application No. PCT/KR03/00760 mailed Jun. 16, 2003.

* cited by examiner

*Primary Examiner*—Melvin Jones
(74) *Attorney, Agent, or Firm*—Patents & TMS, P.C.

(57) ABSTRACT

Device for cooling an object according to the present invention, which comprises a deformable sleeve-like body (1) which includes an inner compartment (3) intended to contact the object and housing a non-freezing cooling liquid and an outer compartment (4) surrounding the inner compartment and housing an insulator, wherein the sleeve-like body has a variable inner diameter, which allows an adjustment thereof to objects having different outer dimensions, and wherein the insulator includes a compressible resilient material. The outer compartment is manufactured of cloth having air-permeability, elasticity and water absorption property.

1 Claim, 2 Drawing Sheets

DEVICE FOR COOLING OBJECT

FIELD OF THE INVENTION

The invention relates to a device for cooling an object. Such a device is known EP 0 526 928 B1.

DESCRIPTION OF THE PRIOR ART

At the present several devices for cooling an object are known. One type of a known device for cooling an object comprises a rigid receptacle for receiving the object. The receptacle is double walled, wherein a temperature fluid is trapped between an inner and outer wall.

A second type of a known device for cooling an object comprises a bag containing a cooling liquid or alike. The bag may be applied on or around the object.

A device according the first type referred to above has as major disadvantage that it is rather clumsy and space consuming. Generally such a device is only well suited for cooling one type of objects having specific dimension.

Although a device according to the second type mentioned above is more flexible in its use, a major disadvantage is its disability to direct the cold only to the object to be cooled and not to the surroundings.

For solving the disadvantages, there is known one invention disclosed in EP 0 526 928 B1 which comprises a deformable sleeve-like body which includes an inner compartment intended to contact the object and housing a non-freezing cooling liquid and an outer compartment surrounding the inner compartment and housing an insulator, wherein the sleeve-like body has a variable inner diameter, which allows an adjustment thereof to objects having different outer dimensions, and wherein the insulator includes a compressible resilient material, and the outer compartment is communicated with the surroundings through at least one opening.

If the device is applied around the object having an outer diameter necessitating a larger inner diameter of the sleeve-like body the inner compartment contacting the object is pressed outwardly, such that the outer compartment is deformed while compressing the resilient material. The air in the outer compartment is vented through the opening. Therefore, the compressible resilient material on the one hand enables a change of the inner diameter of sleeve-like body and on the hand ensures, through its resiliency, a positive engagement of the inner wall of the inner compartment on the object to be cooled. Deforming the outer compartment is made possible by the opening, allowing the air to escape. If the object is removed from the sleeve-like body the resilient material will resume its original shape and air is sucked in through the opening.

Unfortunately, the device has the disadvantage that, air in the outer compartment can not be easily and rapidly vented through the opening because tearing may be occurred in the outer compartment, for example from the opening provided in the outer compartment due to feature of itself material, that is feature of elastic foil, so that number and size of the opening are limited.

Further, the device has the disadvantage that, water drops may be condensed on an outer surface of the outer compartment since the outer compartment has no water absorption property although the outer wall of the outer compartment is made of a material having low heat transferability.

SUMMARY OF THE INVENTION

It is the object of this invention to provide a new and improved device for cooling an object in which the disadvantages of the known device have been avoided.

The object can be achieved by a device for cooling an object according to the present invention, which comprises a deformable sleeve-like body which includes an inner compartment intended to contact the object and housing a non-freezing cooling liquid and an outer compartment surrounding the inner compartment and housing an insulator, wherein the sleeve-like body has a variable inner diameter, which allows an adjustment thereof to objects having different outer dimensions, and wherein the insulator includes a compressible resilient material, characterized in that the outer compartment is manufactured of cloth having air-permeability, elasticity and water absorption property.

DETAILED DESCRIPTION OF THE PREFERRED EMBODIMENTS

Figure 1:
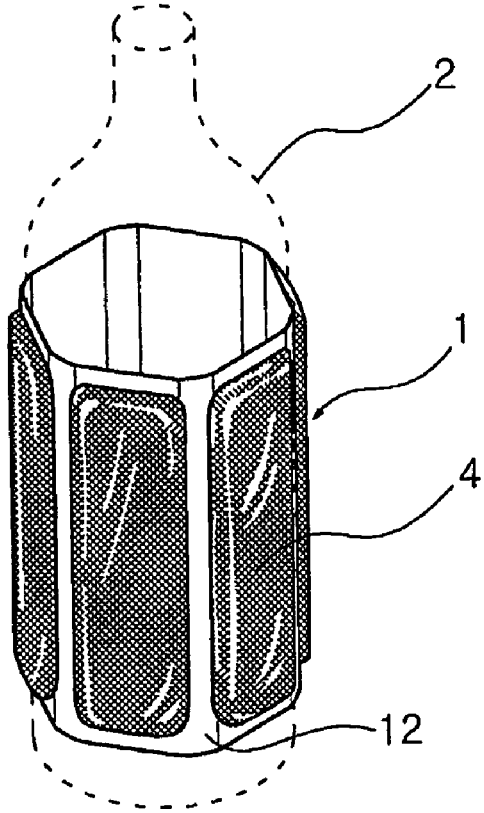
FIG. 1 shows in a perspective view an embodiment of the device according to the invention.
Figure 2:
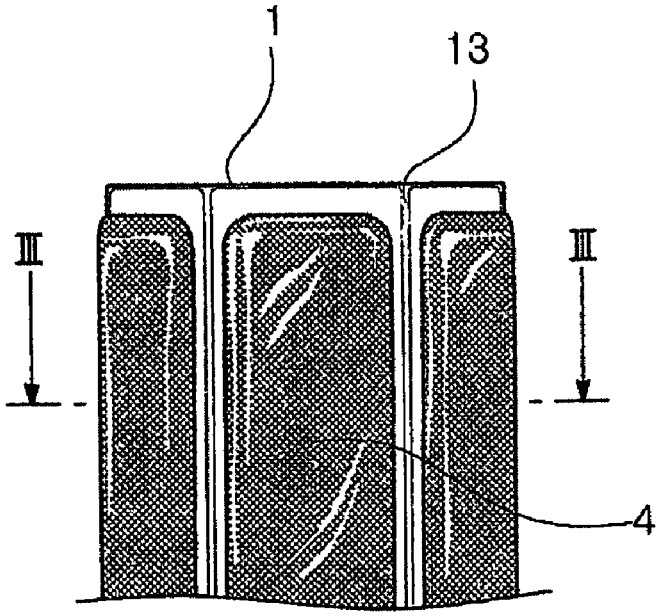
FIG. 2 shows on a larger scale, the device FIG. 1 in an elevational view.

The device for cooling an object shown in FIG. 1 consists of a deformable sleeve-like body 1. A bottle 2 shown by dotted line in FIG. 1 has been indicated around which this sleeve-like body 1 may be positioned.

Figure 3:
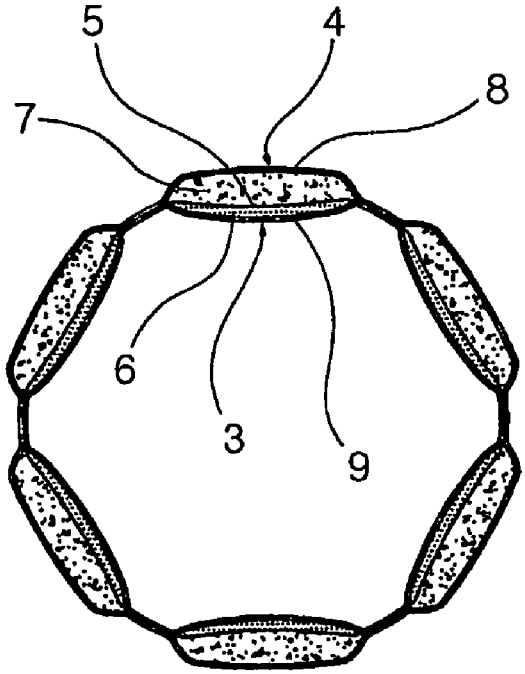
FIG. 3 shows a cross-sectional view according to III—III in FIG. 2.

As clearly illustrated in FIG. 3, the sleeve-like body 1 comprises a number of inner compartments 3. Further the sleeve-like body 1 comprises six outer compartments 4.

The inner compartments 3 and outer compartments 4 are separated by a partition wall 5. Each inner compartment 3 accommodates a non-freezing cooling liquid and each outer compartment 4 accommodates an insulator 7 made of a compressible resilient material, such polyester foam. The outer compartments 4 are manufactured of cloth having air-permeability, elasticity and water absorption property.

In the state of FIG. 1, the sleeve-like body 1 is in a relax position and not positioned around an object such as the bottle 2 to be cooled. In this position, the compressible resilient material 7 is expanded, whereas the inner compartments 3 extend inwardly from the sleeve-like body 1.

Figure 4:
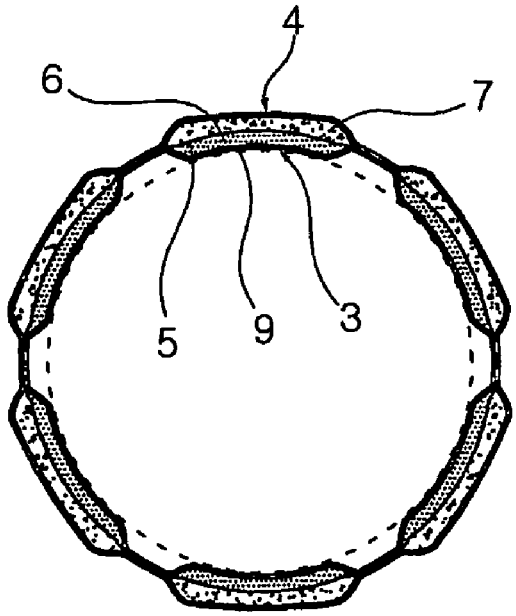
FIG. 4 shows a cross-sectional view of FIG. 3, after the device has been positioned around an object.

If the cooling device according to the invention is positioned around the bottle 2, the inner compartments 3 are pressed outwardly by contacting with the bottle 2. Because of the fact that the volume of the cooling liquid does not change the partition wall 5 is pushed outwardly together with the inner compartments 3. The outer wall 8 of the outer compartments 4 will resist the outwardly directing movement, so that the resilient material 7 housed in the outer compartments 4 will be compressed between the inner compartments 3 and the outer compartments 4, as shown in FIG. 4. The amount of outward movement of the inner compartments 3 and thus the amount of the compression of the resilient material 7 will depend on the diameter of the bottle 2.

Because of the resiliency of the resilient material 7, the inner wall 9 of the inner compartments 3 contacts closely with the outer surface of the bottle 2, as shown in FIG. 3. Therefore, an effective heat transfer occurs between the inner wall 9 of the inner compartments 3 and the bottle 2.

When the resilient material 7 is compressed, air contained in the outer compartments 4 escapes from the entire outer surface thereof while the outer compartments 4 made of cloth having elasticity is slightly extended, since the outer compartments 4 are manufactured with cloth having air-permeability, according to the invention.

For collecting drops of condensating water, the sleeve-like body 1 may be neat to its end 12 be provided with an inwardly extending collar (not shown). Further, since the outer compartments 4 are manufactured of clothe having water absorption property, water drops can be condensed on the outer compartments 4.

As known from the above, the device for cooling an object according to the invention is manufactured cloth along with plastic foils available on the markets. For creating these compartments 3, 4, cloth for forming the outer compartments 4 and plastic foils for forming the inner compartments 3 are welded together at welding lines 13. Directly adjacent to these welding lines 13, the inner compartments 3 may be partly evacuated, such that they are not completely filled with cooling liquid. This enhances the deformity of the sleeve-like body 1.

Preferably, the inner wall 9 of the inner compartments 3 is manufactured of a thin material having excellent heat transferability, whereas the outer compartments 4 are manufactured of a material such as cloth having low heat transferability. Further, it is preferable that inner wall 9 of the inner compartments 3 is manufactured of an elastic material.

Further, the device of the present invention is continually in direct intimate contact with and places pressure upon the object which is to be cooled. The cooling period can also be controlled by the manner in which the inner wall of the inner compartments contacts the object to be cooled. The less the elements are pressed against the object the longer the cooling cycle. As pointed out, the compartments may be designed to fit a single diameter or outer shape of a bottle or can or maybe flexible to accommodate several different sizes. If desired, temperature sensitive print could be placed on the sleeve-like body that change color within a certain temperature range to provide an indication of the temperature being transferred to the object which is being cooled.

As the above mentioned, according to the invention, since the outer compartments are manufactured of cloth having air-permeability, elasticity and water absorption property, it is possible to prevent the outer compartments from tearing and to prevent water drops from condensing on the outer compartments.

It will be apparent that many applications will lend themselves to utilization of this invention. Although the invention is particularly suited for cooling canned or bottled beverages, the invention could be utilized for keeping items warm and in medical applications for applying heating or cool compresses to an area of an injured victim.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. A device for cooling an object, the device comprising:

a deformable sleeve-like body having an inner compartment contacting the object and housing a non-freezing cooling liquid; and an outer compartment surrounding the inner compartment wherein the outer compartment has an exterior surface and an interior surface wherein the interior surface of the outer compartment is adjacent to the inner compartment wherein the outer compartment houses an insulator, wherein the sleeve-like body has a variable inner diameter which allows an adjustment of the sleeve-like body to objects having different outer dimensions and further wherein the insulator has a compressible resilient material wherein the outer compartment is manufactured of cloth wherein the exterior surface of the outer compartment is permeable to a liquid or a gas and further wherein the cloth is elastic.

* * * * *